US007942612B1

(12) United States Patent
Willison

(10) Patent No.: US 7,942,612 B1
(45) Date of Patent: May 17, 2011

(54) POST HOLE SHORING APPARATUS

(76) Inventor: Christopher H. Willison, Norton, OH (US)

( * ) Notice: Subject to any disclaimer, the term of this patent is extended or adjusted under 35 U.S.C. 154(b) by 0 days.

(21) Appl. No.: 12/416,484

(22) Filed: Apr. 1, 2009

Related U.S. Application Data

(60) Provisional application No. 61/041,634, filed on Apr. 2, 2008.

(51) Int. Cl.
*E02D 5/74* (2006.01)

(52) U.S. Cl. ..... 405/244; 52/153; 52/165; 256/65.14

(58) Field of Classification Search ..... 405/231, 405/232, 244; 52/153, 154, 156, 165; 248/545, 248/156, 530, 353; 256/65.14
See application file for complete search history.

(56) References Cited

U.S. PATENT DOCUMENTS 3,342,444 A * 9/1967 Nelson ..... 52/165
3,694,978 A * 10/1972 Mintz ..... 52/166
4,269,010 A * 5/1981 Glass ..... 52/154
4,972,642 A * 11/1990 Strobl, Jr. ..... 52/165
5,082,231 A * 1/1992 Knowles ..... 248/545
5,661,932 A * 9/1997 Barefield ..... 52/154
5,899,030 A * 5/1999 Barefield ..... 52/154
5,984,587 A * 11/1999 Odle ..... 405/244
6,257,557 B1 * 7/2001 Anderson et al. ..... 256/65.14
6,523,808 B1 * 2/2003 Lehmann ..... 256/65.14
6,729,089 B1 * 5/2004 Spragg ..... 52/296
7,627,994 B1 * 12/2009 Demirkan ..... 52/165

* cited by examiner

*Primary Examiner* — Frederick L Lagman
(74) *Attorney, Agent, or Firm* — John D. Gugliotta, PE, Esq

(57) ABSTRACT

A post hole shoring device is provided for receiving and securing a vertically extended 4×4 post. The post would be placed within a hole, secured with concrete, and the hole formed would be backfilled with the soil removed from the hole. By use of the shoring device around the post at the bottom of the hole, additional vertical support is provided to strengthen the vertical installation and prevent movement of the post. The shoring device can be back-filled over, or even filled with aggregate or concrete to provide additional support at very little cost and without modifying conventional materials or construction techniques.

8 Claims, 12 Drawing Sheets

POST HOLE SHORING APPARATUS

RELATED APPLICATIONS

The present application claims benefit of U.S. Provisional Application 61/041,634 filed on Apr. 2, 2008. There are no other co-pending applications, anywhere in the world.

BACKGROUND OF THE INVENTION

1. Field of the Invention

The present invention relates generally to posts mounted within a created post hole and, more particularly, to an improved shoring device to allow for support of vertical construction post.

2. Description of the Related Art

Conventional 4×4 construction timbers are widely known, and used, in the construction trade for providing support for many structures. From decks, to mailboxes, to yard signs, a conventional 4×4 timber is generally the commodity building element that is the member of first resort. Such a member is usually made to a dimension of 3.5 inches square, with general manufacturing tolerances of plus or minus 0.1 inches. Usually, the installation of a such a member in the vertical position requires the excavation of a hole into the soil to a level below the frost line, and of an overall width to form a volume that, when filled with concrete, has sufficient mass to provide rigidity, prevent heaving, and withstand the torsional stresses that can be placed on the particular structure. However, the use of concrete in direct contact with such pressure treated lumber is not always desirable and is often discouraged in that it will shorten the stated life and benefits associated with such pressure treated lumber.

The use of such widely available elements in construction have other drawbacks as well. For example, a mailbox or signpost usually supports a cantilevered element of some mass. Further, the supported structure is generally a distance above ground level that is multiples of the distance that the supporting members are anchored. As such, angular, torsional and rotational stress are multiplied and can easily lead to movement of the support beam within the hole, resulting in twisting, droop, or otherwise compromised securement.

A search of the prior art did not disclose any patents that read directly on the claims of the instant invention. Consequently, a need has been felt for providing an apparatus and method of shoring a conventional 4×4 post.

SUMMARY OF THE INVENTION

It is therefore an object of the present invention to provide an improved post hole shoring apparatus and method.

It is a feature of the present invention to provide an improved post hole shoring device that can be use both in a post hole dug by otherwise conventional methods, and with an otherwise conventional 4×4 wood post.

Briefly described according to one embodiment of the present invention, a post hole shoring device is show having an outer circumferential shell of an overall diameter exceeding that of the post to be supported. The shell outer forms a plurality of extended stabilizing fins that, when interfaced with the soil forming the post hole wall creates a rotational impingement force. A rectangular inner support wall is designed to fit snugly against an otherwise conventional 4×4 post without modification, yet incorporates tolerance adjustment hinges to accommodate variances of manufacturing tolerances in the dimensions of the post such as to form adaptable corner slots to provide directionality and quantitative tolerance accommodation, as needed.

An advantage of such an inner support wall is that it provides a moisture barrier as well to prevent the direct contact of poured concrete with the lumber surface.

Another advantage of the present invention is that it provides resistance to rotational spinning forces imparted onto a vertically extended, earth sunk post.

Yet another advantage of the present invention is that it provides resistance to angular "droop" caused by the leverage effect of a cantilevered mass mounted upon an elongated post.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
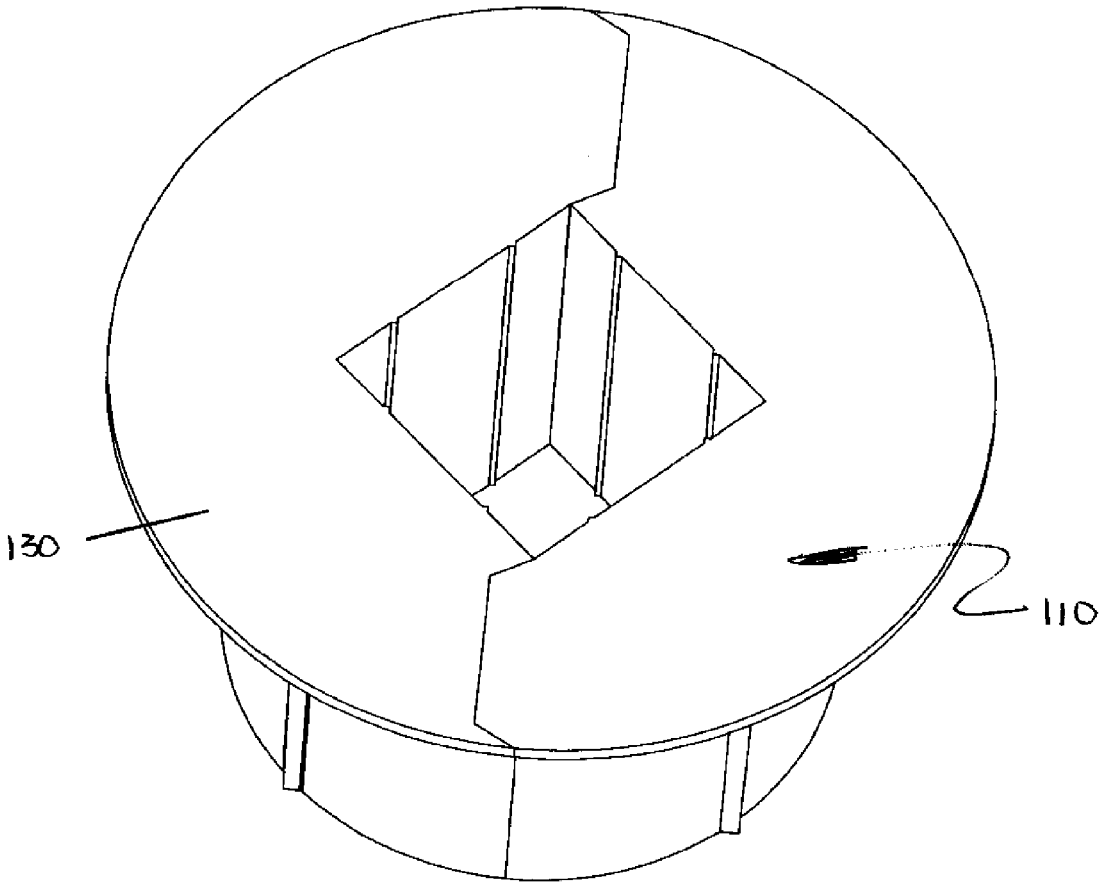
FIG. 1 is a photograph of a top perspective view of a post hole shoring apparatus according to a preferred embodiment of the present invention.
Figure 2:
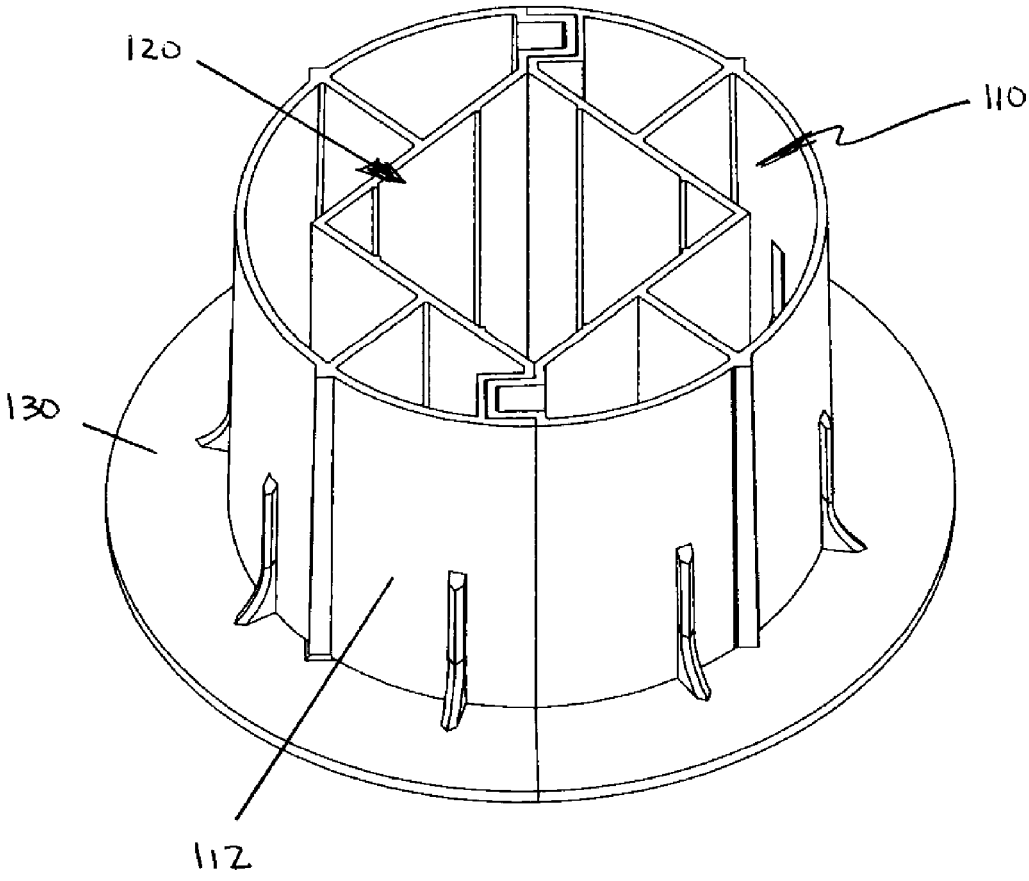
FIG. 2 is a photograph of a bottom perspective view thereof.
Figure 3:
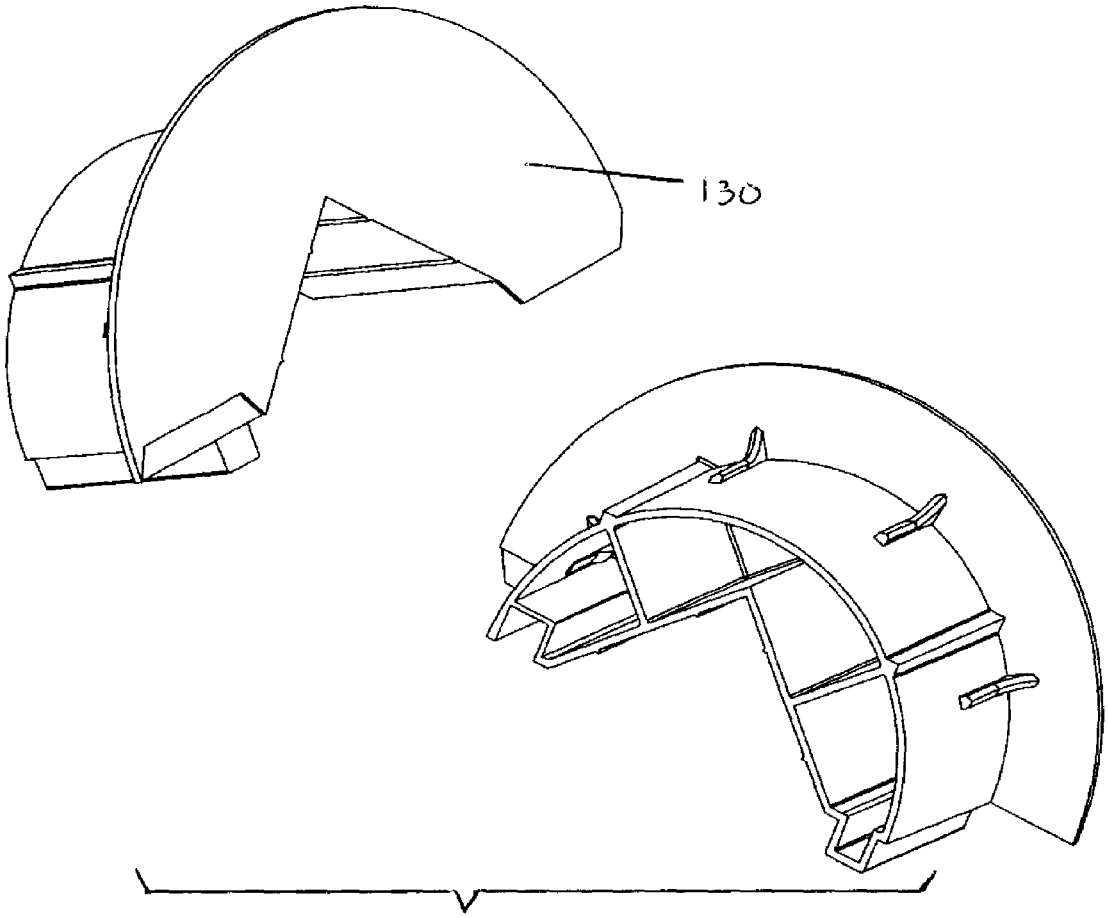
FIG. 3 is a photograph showing the post hole shoring apparatus of the present invention in a disassembled state.

The best mode for carrying out the invention is presented in terms of its preferred embodiment, herein depicted within the Figures.

1. Detailed Description of the Figures

Referring to FIGS. 1-9, a preferred embodiment for a post hole shoring device, generally noted as 110, is show intended to be used in interlock pairs around an otherwise conventional 4×4 post timber. A generally semi-cylindrical body has an outer circumferential shell 112 on one side, and forms a perpendicular inner sidewall 120 on the opposite side. A stabilizing fins 114 confects each sidewall element 120*a* to the outer shell 112. At a first intersecting corner is formed a receiving notch 122, and at a second intersecting corner is formed an extension tab 124. It is anticipated that the tab 124 of a second device 110 would snugly fit within the notch 122 of a first device 110. The connection of such joints would form a tolerance adjustment connection.

Additionally, an upper terminating flange surface 130 extends outward from the radial sidewall 112.

Referring now to FIGS. 10-13, a post hole shoring device, generally noted as 210, is show as a generally cylindrical body having an outer circumferential shell 212 of an overall diameter exceeding that of the post to be supported. The shell 212 outer surface forms a plurality of radially extended stabilizing fins 214. A rectangular (shown herein as square) inner support wall 216 is designed to fit snugly against an otherwise conventional 4×4 post without modification. At each corner is a tolerance adjustment hinge 18. The inner support wall 216 is connected to the outer shell 12 via a series of aligned stress transfer walls 220.

The inner support wall 216 is adapted to snugly receive an otherwise conventional 4×4 construction timber, and as such has sidewall lengths of 3.6 inches. Each tolerance adjustment hinge 218 is formed as a slotted, radially disposed slot at each corner. In this configuration, stresses on each support wall element 216*a* caused by out of tolerance or slightly oversized construction timbers will cause the hinge 218 to expand, the sidewall element 216*a* to flex, and the stress transferred to the outer shell 212 through the stress transfer walls 220. Similarly, external rotational or torsional stresses placed along the shell 212 will be transferred inward, as needed.

Further, a series of concrete receiving cavities 224 are formed between the shell 212 and the walls 220 such as to provide a sufficient anchoring volume that is still isolated from surface contact with any lumber by the individual wall elements 216*a*. Such an embodiment can be easily formed by an extrusion technique to be made in any convenient overall linear length.

2. Operation of the Preferred Embodiment

Figure 4:
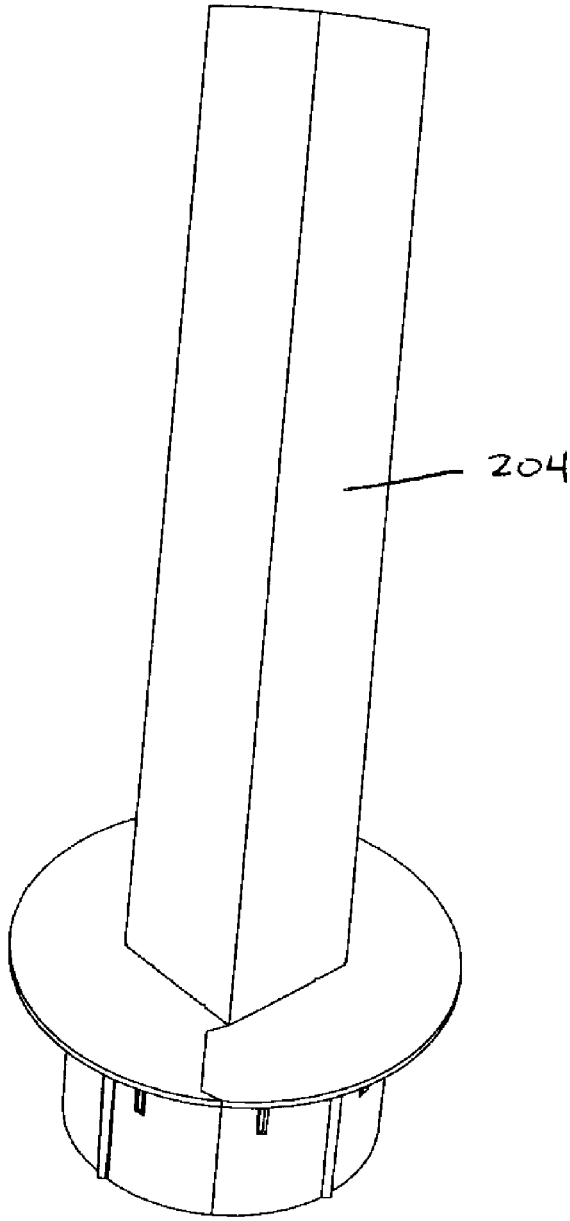
FIG. 4 is a photograph showing the post hole shoring apparatus of the present intention shown in use with a 4×4 post.
Figure 5:
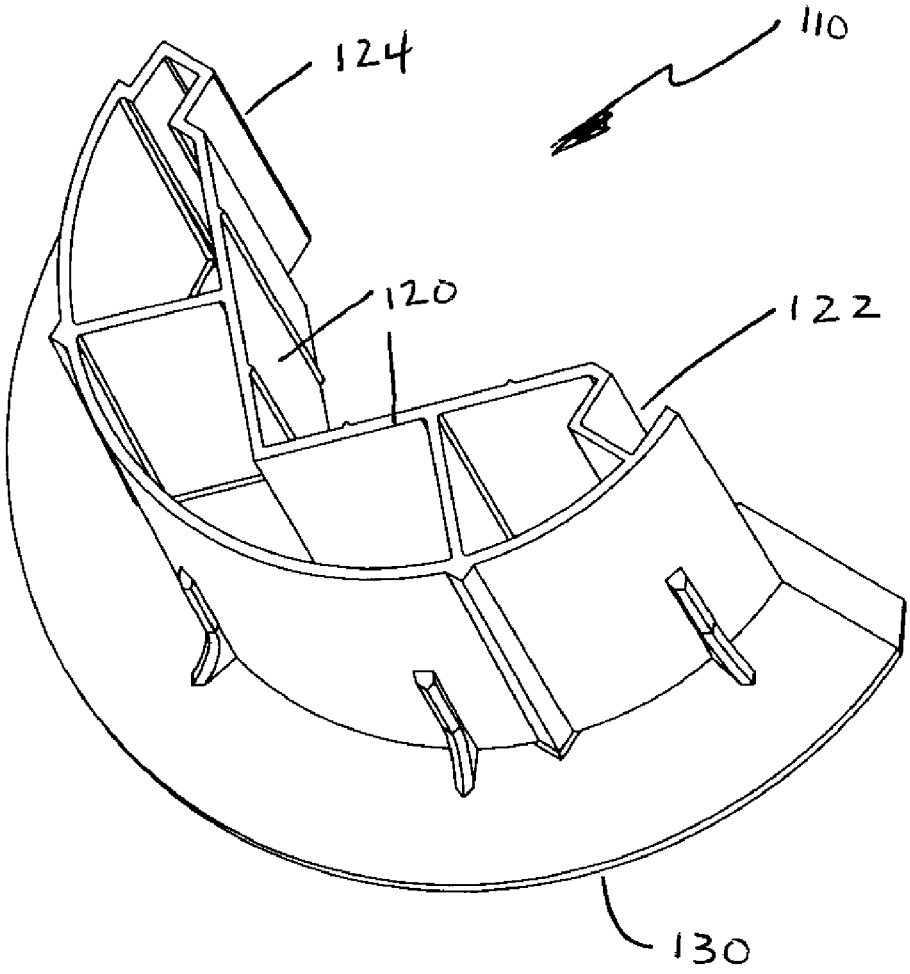
FIG. 5 is a perspective view of a post hole shoring apparatus of the present invention.
Figure 6:
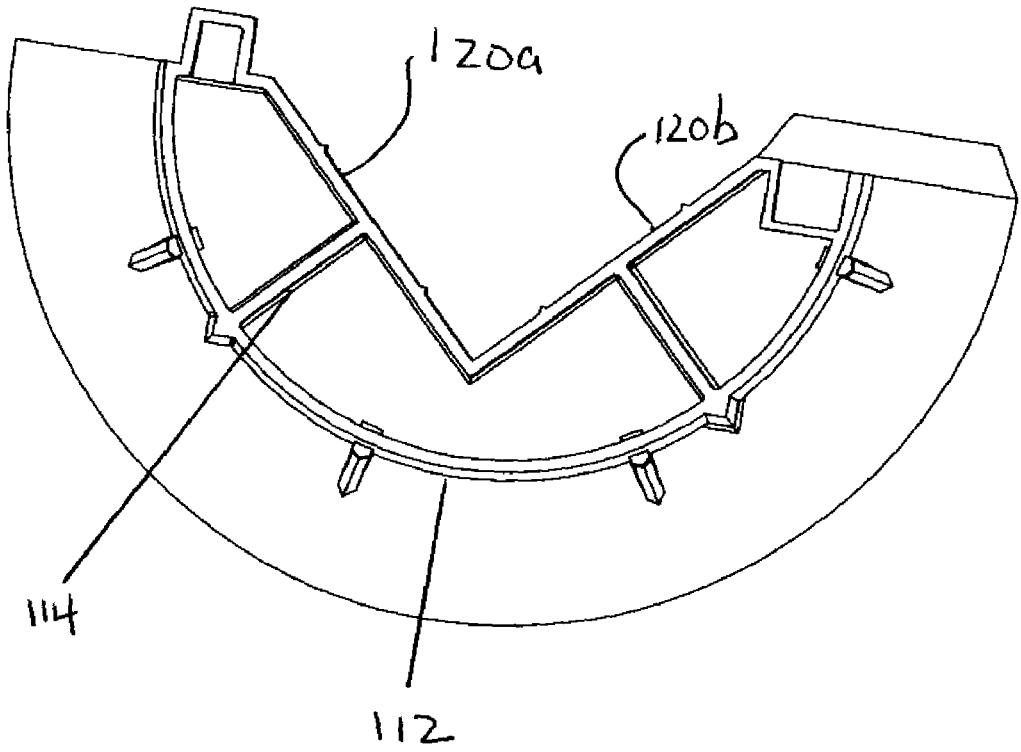
FIG. 6 is a bottom plan view thereof.
Figure 7:
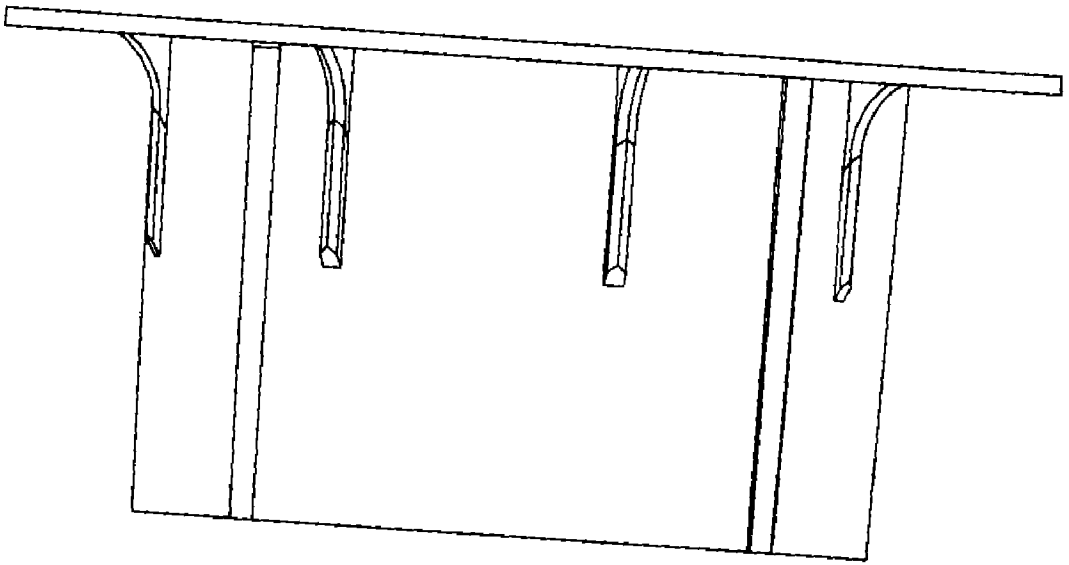
FIG. 7 is a side elevational view thereof.
Figure 8:
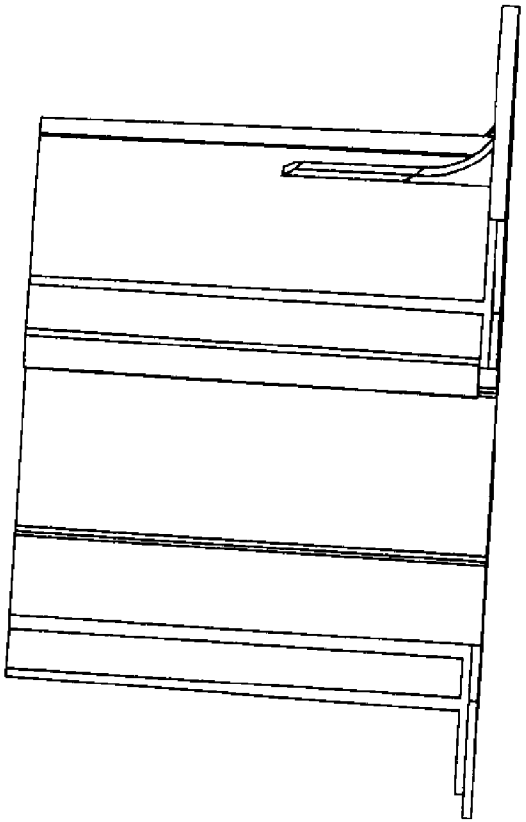
FIG. 8 is a reverse side elevational view of FIG. 7.
Figure 9:
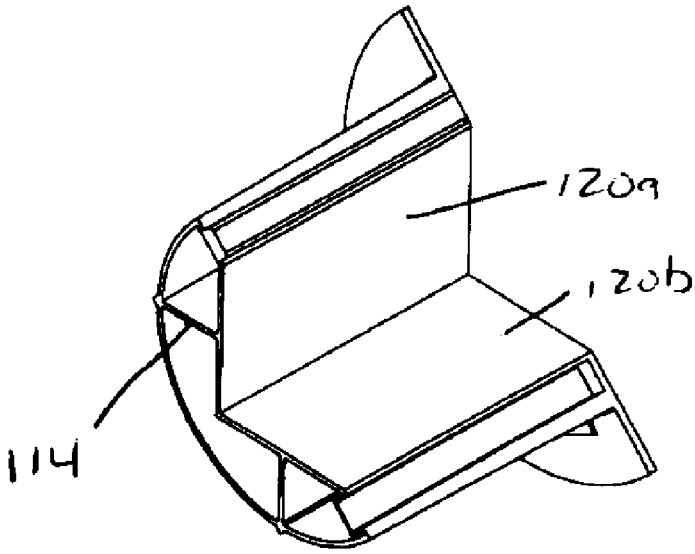
FIG. 9 is a reverse perspective view thereof.
Figure 10:
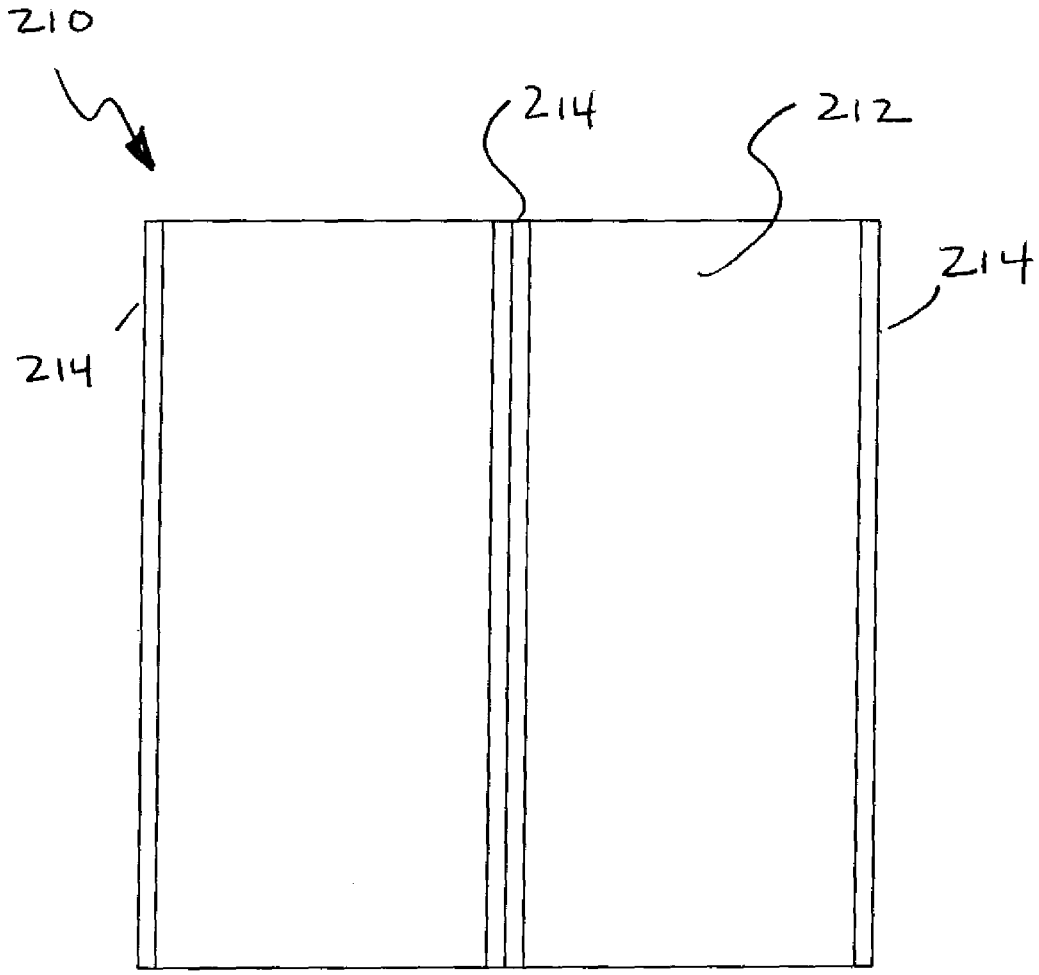
FIG. 10 is a side elevational view of a post hole shoring apparatus according to a first alternate preferred embodiment of the present invention.
Figure 11:
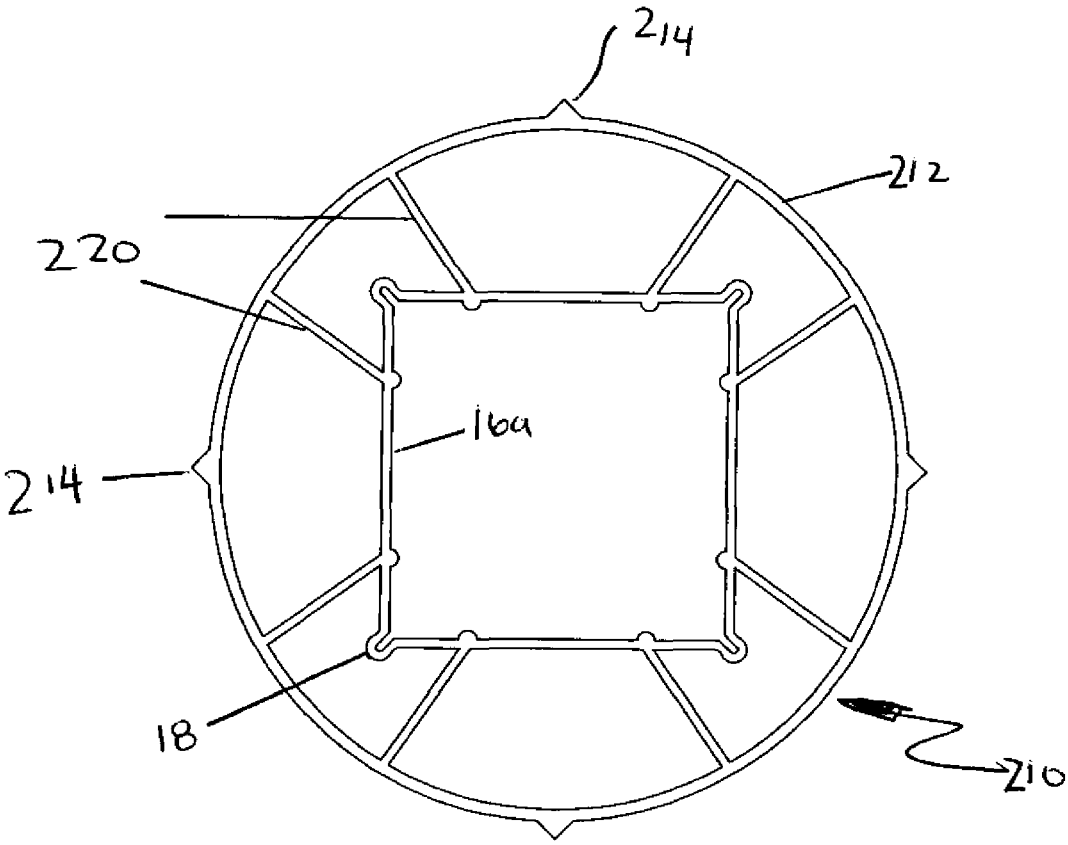
FIG. 11 is a top plan view thereof, the bottom plan view being a mirror image.
Figure 12:
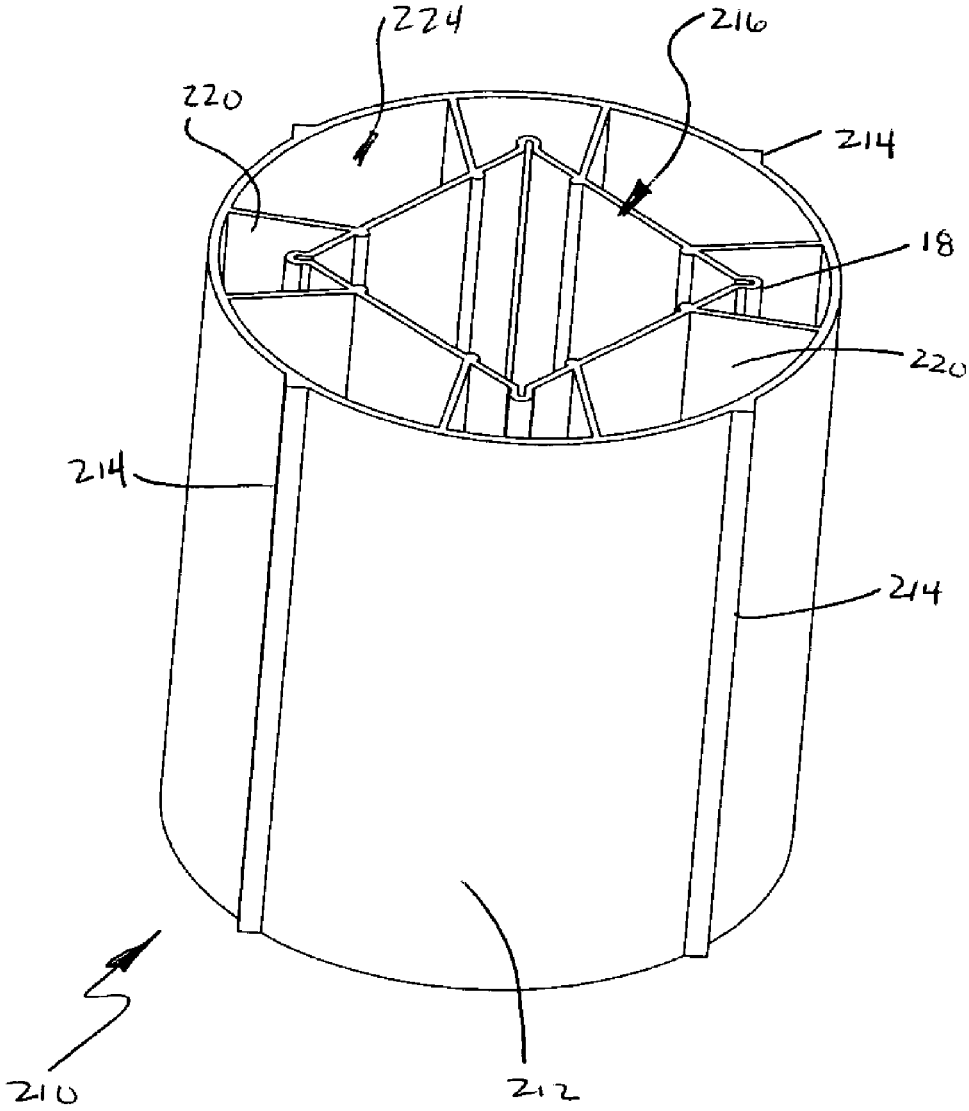
FIG. 12 is a perspective view thereof.

In accordance with a preferred embodiment of the present invention, as shown in FIG. 4, depict a post hole shoring device 110 in use. As would be done in a conventional manner, a receiving hole is provided, preferably below the frost line, for receiving and securing a vertically extended 4×4 post 204. With such a construction technique it is generally anticipated that the post 204 would be secured with concrete into the anchoring cavities 120, and the hole 200 formed would be backfilled with the soil removed from the hole. However, such a technique, by disturbing the hole soil, make the post susceptible to rotational forces, or angular forces, causing the post to pivot or droop. By use of the shoring device 110 around the post 204 at the bottom of the hole 200, additional vertical support is provided to strengthen the vertical installation and prevent movement of the post. The shoring device 110 can be back-filled over, or even filled with aggregate or concrete to provide additional support at very little cost and without modifying conventional materials or construction techniques.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined broadly by the drawings and descriptions herein and their equivalents. Therefore, the scope of the invention is to be limited only by the following claims.

Having thus described the invention what is claimed as new and desired to be secured by Letters Patent is as follows:

1. A post hole shoring device comprising:

a generally cylindrical body having an outer circumferential shell of an overall diameter exceeding that of the post to be supported;

a rectangular inner support wall adapted to fit snugly against an otherwise conventional 4×4 post; and a series of aligned stress transfer walls connecting said inner support wall to said outer shell; and a tolerance adjustment hinge firmed as a slotted, radially disposed slot at least one corner.

2. A post hole shoring device comprising:

a generally cylindrical body having an outer circumferential shell of an overall diameter exceeding that of the post to be supported;

a rectangular inner support wall adapted to fit snugly against an otherwise conventional 4×4 post; and a series of aligned stress transfer walls connecting said inner support wall to said outer shell;

said outer circumferential shell forms at least one radially extended fin; and a tolerance adjustment hinge formed as a slotted, radially disposed slot at least one corner.

3. The post hole shoring device of claim 2, wherein said inner support wall is generally formed in having sidewall lengths of between 3.4 and 3.6 inches.

4. A post hole shoring device comprising:

a first generally semi-cylindrical body having an outer circumferential shell of an overall diameter exceeding that of the post to be supported;

a second generally semi-cylindrical body having an outer circumferential shell of an overall diameter exceeding that of the post to be supported and intended to be used in interlock pairs with said first generally semi-cylindrical body around an otherwise conventional 4×4 post timber;

wherein each generally semi-cylindrical body has an outer circumferential shell on one side, and forms a perpendicular inner sidewall on the opposite side; and further comprising a first intersecting corner forming a receiving notch and at a second intersecting corner forming an extension tab to snugly fit within the notch of a first device.

5. The post hole shoring device of claim 4, further comprising upper terminating flange surface extending outward from said radial sidewall.

6. A post hole shoring device comprising:

a first generally semi-cylindrical body having an outer circumferential shell of an overall diameter exceeding that of the post to be supported, wherein said outer circumferential shell forms at least one radially extended fin;

a second generally semi-cylindrical body having an outer circumferential shell of an overall diameter exceeding that of the post to be supported and intended to be used in interlock pairs with said first generally semi-cylindrical body;

wherein each generally semi-cylindrical body has an outer circumferential shell on one side, and forms a perpendicular inner support wall formed by said first and said second generally semi-cylindrical bodies when interlock, said inner support wall adapted to fit snugly against an otherwise conventional 4×4 post, wherein said inner support wall is generally formed in having sidewall lengths of between 3.4 and 3.6 inches; and a series of aligned stress transfer walls connecting said inner support wall to said outer shell;

a tolerance adjustment hinge formed as a slotted, radially disposed slot at least one corner.

7. The post hole shoring device of claim 6, further comprising a first intersecting corner is formed a receiving notch and at a second intersecting corner is formed an extension tab to snugly fit within the notch of a first device.

8. The post hole shoring device of claim 6, further comprising upper terminating flange surface extending outward from said radial sidewall.

* * * * *